United States Patent [19]

Goossens et al.

[11] 4,253,915

[45] Mar. 3, 1981

[54] PRESSURE ROD FOR A COKE DISCHARGE APPARATUS

[75] Inventors: Walter Goossens, Wuerselen-Bardenberg; Wolfgang Schrank, Aldenhoven, both of Fed. Rep. of Germany

[73] Assignee: Hartung, Kuhn & Co. Maschinenfabrik GmbH, Dusseldorf, Fed. Rep. of Germany

[21] Appl. No.: 50,863

[22] Filed: Jun. 22, 1979

[30] Foreign Application Priority Data

Jun. 24, 1978 [DE] Fed. Rep. of Germany ..... 2827882

[51] Int. Cl.[3] ..... C10B 33/10

[52] U.S. Cl. ..... 202/262; 202/270; 414/214; 414/586

[58] Field of Search ..... 202/262, 270; 414/173, 414/587, 786, 214, 586

[56] References Cited

U.S. PATENT DOCUMENTS

| | | | |
|---|---|---|---|
| 2,165,141 | 7/1939 | Hecht | 414/214 |
| 3,784,034 | 1/1974 | Thompson | 202/262 X |

*Primary Examiner*—Frank W. Lutter
*Assistant Examiner*—Roger F. Phillips
*Attorney, Agent, or Firm*—W. G. Fasse; D. F. Gould

[57] ABSTRACT

The present pressure rod for a coke discharge apparatus is constructed of hollow sectional components or tubular members interconnected with one another, whereby a lightweight structure is achieved. The hollow sectional components or tubular members are interconnected in such a manner that a coolant may flow through the structure of the pressure rod. Flexible coolant supply conduits for the inflow and outflow of coolant are connected to the hollow sectional components of the pressure rod.

7 Claims, 3 Drawing Figures

PRESSURE ROD FOR A COKE DISCHARGE APPARATUS

BACKGROUND OF THE INVENTION

The present invention relates to a pressure rod for a coke discharge apparatus. Heretofore such push rods have been constructed of solid sectional steel.

The solid construction was necessary heretofore in order to make certain that the push rods would be capable to withstand the high temperature difference which may exceed more than 1,000° C. between the coking furnace chamber and the free atmosphere outside of the chamber. The solid sectional components are either welded or riveted to form the frame structure of the prior art push rods. As a result, the weight of such prior art pressure rods may be within the range of between 12 to 24 tons depending on the dimensions of the coking chamber furnace. This heavy type of prior art structure is practically not related at all to the forces that must be taken up by such pressure rods when they are in operation to press out a charge of coke from a coking chamber.

The heavy prior art structures resulted from the fact that it was necessary heretofore to take into account the most disadvantageous load condition which may, for example, occur when the coke has been removed from the chamber but the rod cannot be moved forthwith out of the chamber, for example, due to power failure or to a failure in the drive mechanism of the push rod. For safety reasons it is necessary to take these extreme operating conditions into account and therefore prior art push rods of this type have a large weight resulting from taking into account the maximum adverse operating conditions in order to make sure that a push rod which has to be removed from the coking chamber by means of an emergency drive mechanism or even by hand operated drive means causing a delay in the withdrawal, will not be subject to unacceptable deformations which otherwise could result from the prolonged heat exposure.

However, in spite of the large material expenditure it is not always possible to make sure that prior art pressure rods will remain without structural changes within the material texture of the pressure rod due to excessive heating effects. Further, or in the alternative, it is not possible to assure that prior art rods of this type will not be exposed to a nonuniform cooling which also may result in deformations which could possibly make the further use of the pressure rods at least questionable.

OBJECTS OF THE INVENTION

In view of the above it is the aim of the invention to achieve the following objects singly or in combination:

to construct a push rod for the pressing of coke out of a coking chamber, which shall be relatively lightweight in structure yet capable of withstanding high temperature differences without structural changes in the material texture of the push rod;

to construct a coking chamber emptying push rod in such a manner that it will not be exposed to nonuniform cooling thereby avoiding deformations which might result from nonuniform cooling; and to positively cool the push rod by flowing a coolant through the hollow structural components of the push rod.

SUMMARY OF THE INVENTION

According to the invention there is provided a push rod or pressure rod for a coke discharge apparatus, which rod is constructed of hollow sectional components or tubular members. These tubular members form the frame structure of the rod proper and simultaneously a conduit system for flowing a coolant through said frame structure of the hollow push rod.

The push rod according to the invention has the advantage that the heat energy which is building up during the pushing operation and possibly thereafter may be removed by means of a coolant flow thereby avoiding exposing the rod to loads which would otherwise be caused by excessive heat exposure. Prior art structures have been dimensioned primarily with regard to the most adverse operating conditions. Contrary thereto the push rod according to the invention may now be constructed with regard to its power transmitting capability necessary for pressing out coke from a coking chamber thereby taking into account the maximum power requirements and disregarding the loads resulting from temperature variations to which the rod may be exposed.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 3:
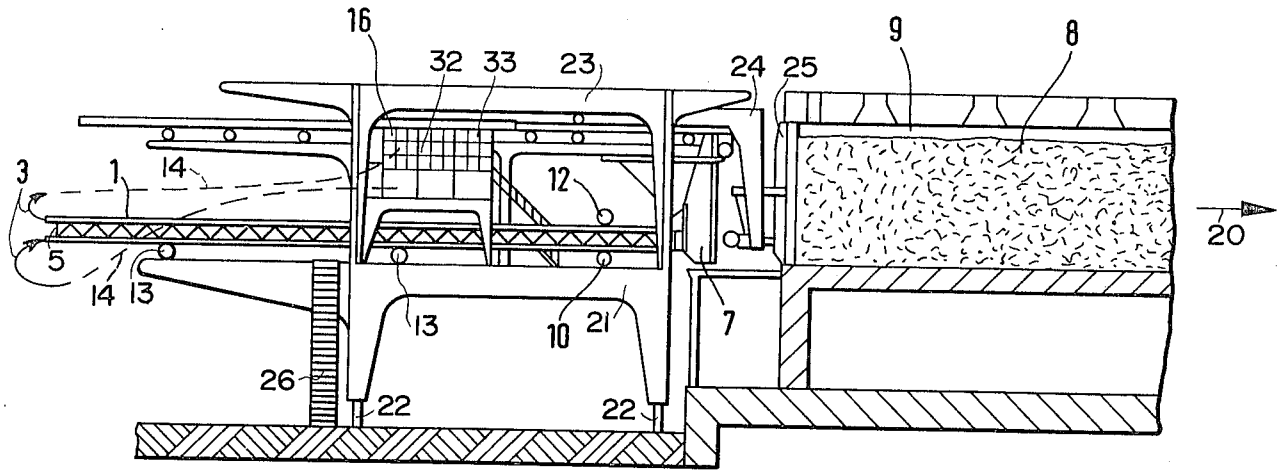
FIG. 3 is a side view of a coke discharge apparatus using a pressure rod according to the invention and located in front of a coking chamber furnace.

Referring first to FIG. 3, the present push rod 1 is intended to move coke 8 out of a coking chamber 9 in the direction of the arrow 20. For this purpose the push rod 1 is operatively supported on a carriage 21 running on rails 22 for sequential alignment with a plurality of coking chambers 9 arranged in a row. The carriage 21 supports an overhead structure 23 carrying equipment 24 for opening and closing the chamber door 25. Such equipment 24 and door 25 are of conventional construction and arranged so as not to interfere with the open position of the door 25, with the movement of the push rod 1 with its pressure head 7 into the chamber 9. The rod 1 is shown in its leftmost position in FIG. 3.

A stair 26 is secured to the carriage 21 and movable therewith to provide access to the components supported on the carriage 21.

The push rod or pressure rod 1 is supported by lower guide rollers 13 which in turn are conventionally supported on the carriage 21. The pressure rod 1 is driven by, for example, a rack and pinion structure 10, 11 and guided against upward excursions by guide rollers 12.

The overhead structure 23 on the carriage 21 may support coolant reservoirs 16 as will be described in more detail below.

Figure 1:
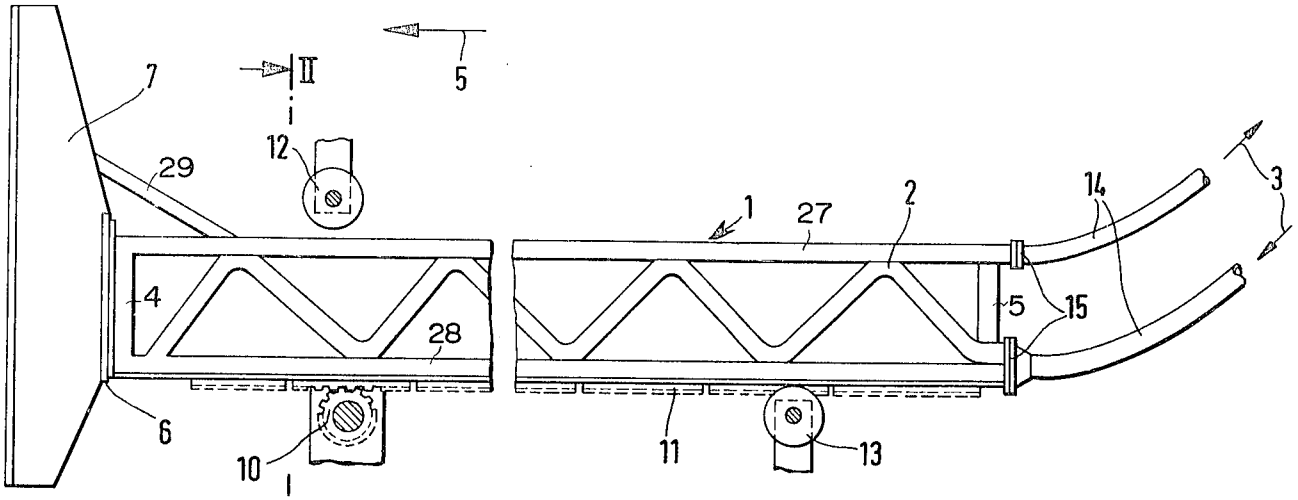
FIG. 1 is a side view of a push rod constructed according to the invention.

Referring to FIG. 1 showing a side view of the push or pressure rod 1 according to the invention, the present pressure rod 1 is constructed of hollow sectional tubular members including an upper member 27 and a lower member 28 connected to each other by further hollow tubular members 2 forming a truss type of beam the ends of which are formed also by hollow members 4 and 5. The front end of the push rod 1 carries a pressure head 7 secured to the front end member or members 4 through an end plate 6. A bracing element 29 may connect the pressure head 7 to the rod structure 1.

Figure 2:
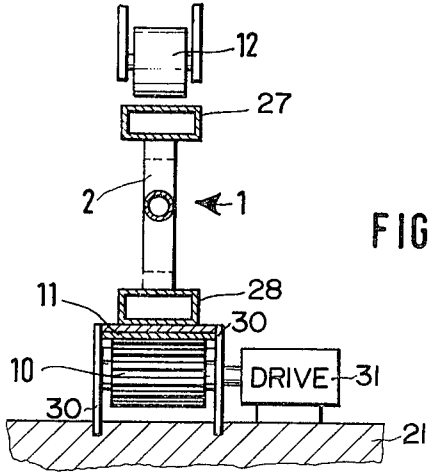
FIG. 2 is a sectional view along section line 2—2 in FIG. 1.

The lower tubular member 28 has secured thereto toothed rack segments 11 meshing with a drive pinion 10 rotatably supported on the carriage 21 by bearing shields 30 and driven by conventional drive means 31. As best seen in FIG. 2 the upper tubular member 27 and the lower tubular member 28 may have a rectangular, box type cross sectional shape and the interconnecting tubular members 2 may be round. To form the truss type beam structure for the rod 1, the tubular components 2, 4, 5, 27, and 28 may be welded together in a conventional manner.

According to the invention the rear ends of the tubular members 2, 27, and 28 are provided with connecting flanges 15 to which there are secured flexible coolant conduits 14. The flow direction of the coolant through the conduits 14 and thus through the tubular members is indicated by the arrows 3, for example. The coolant may be liquid or it may be gaseous as long as it is capable to conduct the heat taken up by the push rod 1 away from the push rod, for example to a heat exchanger 32 shown in FIG. 3. The arrangement is such that a continuous heat transport away from the push rod is assured.

The above mentioned truss type structure is capable of taking up all kinds of loads including static loads under all operating conditions. During the pressing or discharging operation the push rod 1 moves in the direction of the arrow 5 in FIG. 1 or in the direction of the arrow 20 in FIG. 3. The pressure head 7 engages the coke and moves it out of the coking chamber. The pressure head itself is of conventional construction and secured to the forward end through the plate 6 as described.

The toothed segment or segments 11 are driven by the pinion 10 through the motor gear drive 31. The guide rollers 13 are so arranged that a linear movement of the rod 1 is assured. In other words, the guide rollers 13 make sure that a lateral excursion or flexing of the rod 1 is prevented.

The first and second flexible coolant conduits 14 are secured through connecting means such as flanges 15 to the hollow tubular members. The opposite ends of the flexible conduits 14 are connected to the coolant supply container 16 which may be combined with the above mentioned heat exchanger 32 and with a circulation pump 33 as shown in FIG. 3. The conduits 14 are long enough and flexible enough to accommodate the back and forth movement of the pressure rod 1. Preferably, the circulation of the coolant is maintained by the pump 33 between individual pressing out operations, whereby the entire closed circuit coolant is used as a cooling system and the heat taken up by the coolant may be discharged to the atmosphere by the heat exchanger 32. The size of the coolant reservoir 16 will depend on the number and size of the furnace chambers 9.

If desired, the operation of the pump 33 and the operation of the drive means 10, 11, and 31 may be coordinated with each other, for example, to operate in synchronism, namely, so that the coolant is circulated whenever the rod moves in one or the other direction. The switch means that are used for this purpose, such as trip dogs and the like are conventional.

Due to the surprisingly simple structure of the rod 1 according to the invention, the total investment costs have been substantially reduced including the coolant circulating means and the coolant reservoir. Thus, these costs correspond to about $\frac{1}{3}$ of the costs of a respective conventional pressure rod. Tests have shown that the operating costs for an apparatus equipped with a push rod according to the invention correspond substantially to the operating costs for conventional machines because the electric energy necessary for the drive mechanism is substantially smaller as compared to the electric energy required for driving the substantially heavier conventional push rods. Therefore, the additional electrical energy required for circulating or conveying the coolant through the closed coolant circulating system are substantially compensated by the fact that the driving energy is less than that needed in conventional systems.

Another advantage of the present invention is seen in that the push rods as disclosed herein may be installed in conventional coke discharge apparatus without any structural modifications in such conventional apparatus. Moreover, the weight of the present push rods is only within the range of about 4 to 8 tons depending on the dimensions of the respective coking chambers. This weight reduction down to about $\frac{1}{3}$ of the weight of conventional push rods itself constitutes a substantial advance in this art.

Due to the cooling of the entire push rod, the latter retains its load bearing capabilities throughout the entire pressing operation because the heat energies are continuously removed from the push rod even if the latter should be stuck inside a coking chamber, for example, due to power failure.

Due to the use of a coolant reservoir, it is possible to continuously recirculate and hence reuse the coolant.

The size of the coolant reservoir should be selected so that a desired temperature for the coolant may be maintained. Thus, the size of the reservoir will depend on the size of the coking chambers.

By maintaining the coolant circulation even after withdrawal of the rod from the coking chamber, the entire truss structure may operate as a heat exchanger for releasing the heat taken up by the coolant to the atmosphere, or the heat may be used for other purposes.

The above mentioned dimensions for the coolant reservoir may be smaller if a refrigeration device is combined with the coolant circulatory system. For example, the heat exchanger 32 may comprise a compressor type refrigeration device. If desired, the coolant circulatory system may be combined with a heater device for the utilization of the heat retrieved from the push rod.

Although the invention has been described with reference to specific example embodiments, it will be appreciated, that it is intended, to cover all modifications and equivalents within the scope of the appended claims.

What is claimed is:

1. A pressure rod for a coke discharge apparatus, comprising a plurality of hollow, sectional members operatively interconnected to form the rod proper, said interconnected, hollow, sectional members being closed in a fluid tight manner for simultaneously forming passage means for flowing a coolant through said hollow, sectional members, and means for connecting coolant supply means to said passage means, said hollow, sectional members forming a hollow truss structure, all of said hollow, sectional members being operatively interconnected for coolant flow through all said hollow, sectional members, said connecting means comprising a first flexible coolant conduit for supplying coolant into said hollow truss structure and a second flexible coolant conduit for discharging coolant from said hollow truss structure, said hollow, interconnected truss structure providing a substantially uniform coolant supply throughout the truss structure.

2. The rod of claim 1, further comprising coolant reservoir means, said first and second flexible coolant conduit means being operatively connected to said coolant reservoir means.

3. The rod of claim 1, further comprising pump means, said first and second flexible coolant circuit means being connected to said pump means for circulating said coolant through said hollow passage means.

4. The rod of claim 3, wherein said pump means maintains the coolant circulation even after completion of a pushing operation.

5. The rod of claim 1, further comprising cooling means operatively connected to said first and second flexible coolant conduit means.

6. The rod of claim 1, further comprising heat exchange means operatively connected to said first and second flexible coolant conduit means.

7. A pressure rod for a coke discharge apparatus, comprising an upper, hollow, tubular member (27), a lower, hollow, tubular member (28); a plurality of hollow, tubular cross members (2) and hollow, tubular end members (4, 5), means operatively connecting all of said hollow, tubular members to form a truss structure and to simultaneously form an interconnected coolant flow network, one of said upper and lower, hollow, tubular members forming an inflow duct, the other of said upper and lower, hollow, tubular members forming an outflow duct, said plurality of hollow, tubular cross members forming substantially a zig-zag duct having upper and lower peaks, said upper peaks being connected to said upper, hollow, tubular member, said lower peaks being connected to said lower, hollow, tubular member, coolant inlet means connected to said inflow duct and to said zig-zag duct and coolant outlet means connected to said outflow duct.

* * * * *